United States Patent [19]

Patrick

[11] Patent Number: 5,056,321

[45] Date of Patent: Oct. 15, 1991

[54] HALF CRESCENT SHAPED ICE PIECE MAKER

[75] Inventor: Kenneth H. Patrick, Rainbow City, Ala.

[73] Assignee: Mid-South Industries, Inc., Rainbow City, Ala.

[21] Appl. No.: 617,012

[22] Filed: Nov. 20, 1990

[51] Int. Cl.[5] ..... F25C 5/08

[52] U.S. Cl. ..... 62/73; 62/351

[58] Field of Search ..... 62/73, 351

[56] References Cited

U.S. PATENT DOCUMENTS

| | | | |
|---|---|---|---|
| 3,362,181 | 1/1968 | Linstromberg | 62/353 X |
| 4,896,513 | 1/1990 | Troscinski | 62/353 X |
| 4,923,494 | 5/1990 | Karlovitz | 62/353 X |

*Primary Examiner*—William E. Tapolcai

*Attorney, Agent, or Firm*—Donald W. Phillion, Sr.

[57] ABSTRACT

An ice maker comprising an elongated freezing tray (100) having arcuately shaped cross sectional configuration with equal-spaced separators (120) formed therein each in a plane normal to the axis of the elongated freezing tray (100) and comprising a rotatable assembly comprising a first hollow, cylindrical shaft (100) rotatably secured near both ends of the tray (100) substantially coincident with the axis of the tray (100) and having generally flat paddle-shaped ejector elements (114 and 115) formed thereon a second hollow, cylindrical non-rotatable shaft (160) positioned within the first cylindrical shaft (106) and non-rotatably secured at one end to the tray (100) assembly; a heating element (113) positioned within the second, hollow cylindrical shaft (160) comprising a power source (309) for supplying power thereto to heat the heating element (113) and by conduction to heat the first and second hollow, cylindrical shaft 160 and the ejector elements (114 and 115) to release the full crescent shaped ice pieces from the ejector element.

16 Claims, 5 Drawing Sheets

HALF CRESCENT SHAPED ICE PIECE MAKER

I. BACKGROUND OF THE INVENTION

This invention relates generally to ice piece makers for refrigerators and the like and more particularly to an improved ice piece maker that makes half crescent shaped ice pieces, and an improved method for making such half crescent shaped pieces.

Perhaps the most prevalent current form of ice piece makers currently employed in home refrigerators and freezers make full crescent shaped ice pieces with crescent shaped parallel sides and a rectangularly shaped cross sectional profile viewed in a plane normal to the parallel sides, and further having a flat, top surface.

The full crescent shaped ice pieces are easily formed and removed from ice piece makers and require simpler and less expensive ice piece making mechanisms than do makers of ice pieces of different configuration—i.e. cubes, cylinders, etc. Because of this feature, the full crescent shape has been preferred by most manufacturers of domestic ice piece makers. It remains, however, that although adequate for many applications, the full crescent shape presents difficulty in use in the home particularly when used for cooling beverage glasses but also in storage, removal and handling of the ice pieces in preparation of beverages and other used for ice pieces.

The full crescent shaped ice pieces, when combined with a beverage in most beverage glasses, have a propensity for aligning themselves in the glass such that the arcuate surface of the ice piece conforms to the inside curvature of the beverage glass so that, when the beverage glass is tilted in order to drink therefrom, the crescent shaped ice piece, in coaction with the inner surface of the beverage glass, forms an effective dam, interfering with the proper flow of the beverage to the mouth of the drinker.

Furthermore, full crescent shaped ice pieces are somewhat difficult to insert in glasses ordinarily used in the home for holding most beverages. More specifically, the length of the top surface of the crescent shaped ice piece coupled with the fact that the ice pieces are frequently found in the collection bin joined together in groups of three or four or more, up to the length of the forming tray, make it difficult to fit such large groups of ice pieces into a glass. Often it is not possible to fit more than two joined full crescent ice pieces into a glass at a time if the glass opening is small.

Furthermore, it is difficult to scoop the crescent shaped ice pieces from the collection bin with a cup or a scoop, for example, because of their size and awkward shape. And even when the crescent shaped ice pieces are successfully scooped out of the collection bin with a cup or scoop, some of them frequently either break off, or simply slip off the scoop and drop on the floor where they slide in all directions. Free ice pieces on a vinyl kitchen floor present about the same dangerous situation as a bar of soap on a wet tiled bathroom floor.

Also, small ice pieces are easier to store in a freezer and are a better size for use in certain appliances such as an ice cream maker or in a blender where they are more easily crushed and blended than are larger ice pieces.

Clearly, the formation of smaller, lighter, and less awkwardly shaped ice pieces, such as half crescent shaped ice pieces, marks a definite improvement in the art of forming ice pieces for use in home refrigerators and also in certain commercial applications such as the manufacturing of ice pieces to be sold in bulk by stores, service stations, etc. Such a half crescent shaped ice piece maker is disclosed in U.S. Pat. No. 4,923,494 issued 5/8/90 to Karlovits and entitled "Making Ice In A Refrigerator."

The Karlovitz patent discloses an elongated freezing tray with an arcuately shaped inner surface divided into crescent shaped cavities by equal spaced separators to form a plurality of crescent shaped cavities. A rotatable shaft 40 is secured at both ends in suitable bearings with its axis coincident with the axis of the arcuately shaped inner surface of said tray and further having three rows of ejector elements 44, 46, and 48 secured to, and extending radially outward from the rotatable shaft 40. Each of these three rows of ejector elements lies in a separate column parallel to the axis of said rotatable shaft and spaced 120° from the adjacent rows of ejector elements.

In its starting position (FIG. 2) the ejector element of one row 40 of ejector elements, identified herein as the primary ejector elements, extends perpendicularly down into the center of a water filled crescent shaped cavity 18 to divide the crescent shaped volume of water into two half crescent shaped volumes of water which are then frozen to form two half crescent shaped ice pieces.

Probably the primary problems encountered with the present day prior art half crescent shaped ice piece makers is that both the leading and lagging rows of half crescent ice pieces become so strongly frozen to the primary ejector element that all or some of the ice pieces will not break loose from the primary ejector element when the ice pieces impact the stripper elements, thus possibly stalling the rotational action of the ejector elements and effectively jamming the ice maker. Human help is then required to break loose the ice pieces from the primary ejector element so that operation of the equipment can continue.

Also, when only some of the leading half crescent ice pieces remain frozen to the primary ejector element and others break loose from the ejector element upon impact with the stripper elements some of the lagging half crescent ice pieces will fall back against the subsequent row of ejector elements.

However, if all of the lagging half ice pieces don't fall back together, the lagging ice pieces that do fall back can easily move transversely on the subsequent row of ejector elements, thereby becoming badly misaligned with the stripper element assembly and causing jamming and possible stalling of the equipment when the subsequent row of ejector element rotates such lagging half crescent ice pieces around to impact the stripper elements. There is also a possibility that the loose, lagging half crescent ice pieces will fall over the end of the lagging row of ejector elements and back into the freezing tray.

A prospective ice making refrigerator purchaser might select an alternate ice making refrigerator not having the above characteristics.

A further characteristic of the above prior art half crescent shaped ice maker is that the half crescent shaped ice pieces often remain frozen to the ejector fingers and to each other so that they often break loose from the ejector elements in a noisy manner and in a clump of half crescent shaped ice pieces which then fall into the collection bin, thereby making additional unwanted noise.

Furthermore, clumps of half crescent shaped ice pieces often don't break up into individual half crescent shaped ice pieces upon impact with the collection, but instead tend to form into a more dense cluster of ice pieces which are frequently unusable.

It would mark a definite improvement in the art to provide a half crescent shaped ice piece maker in which the full crescent shaped ice pieces consisting the leading and lagging rows of half crescent ice pieces remain as full crescent shaped ice pieces until they fall into the collection bin whereupon each individual full crescent shaped ice piece breaks into two individual half crescent shaped ice pieces unattached to other half crescent shaped ice pieces.

II. OBJECTS AND BRIEF STATEMENT OF THE INVENTION

A primary object of the invention is to improve the structure and method of making partial or half crescent shaped ice pieces over the structure and methods of making such ice pieces by known ice makers employing arcuately shaped freezing trays and rotating ejector elements by facilitating the ejection of the full crescent shaped ice pieces from the rotating ejector elements and into the collection bin where they will easily break into two half crescent shaped ice pieces.

A second object of the invention is to facilitate the release of the full crescent shaped ice pieces by heating the rotating primary ejector elements which are initially individually frozen to the ice pieces in the center of each of the full crescent shaped ice pieces, and then ejecting such released, full crescent shaped pieces into a collection bin, with the aid of stripper elements, as half crescent shaped pieces.

A third object of the invention is to employ virtually the same basic structure employed to form full crescent shaped ice pieces by prior art devices to form half crescent shaped ice pieces with relatively small but very significant changes in the ice piece maker, thus eliminating the need for any major changes in tooling or controls in converting existing designs for a prior art full crescent shaped ice piece maker into a half crescent shaped ice piece maker.

A fourth object of the present invention is the improvement of full or half crescent shaped ice piece makers generally.

In accordance with a preferred embodiment of the invention there is provided a half crescent shaped ice piece maker comprising an elongated tray having an inner surface arcuately shaped about a radial axis for holding water and spaced apart separators formed therein normal to the axis of the tray to form a row of water fillable crescent shaped cavities in the tray, with each separator providing a water link between adjacent cavities and with each water link forming a first ice bridge when frozen. A heatable rotatable shaft, having a bore extending substantially through the length thereof and primary (leading) and lagging rows of flat, paddle-like ejector elements extending along first and second planes parallel to the axis of said shaft, is mounted on suitable bearings rotatably secured with respect to the ends of said elongated tray with the axis thereof being substantially coincident with the radial axis of the arcuately configured cross section of the elongated tray.

A non-rotatable Calrod unit or a cylindrical tube containing a suitable non-rotatable heating element such as a non-rotatable folded back, insulated Nichrome heater wire, for example, is positioned within the length of the hollow bore of the rotatable shaft so that the two terminals of the heating element extend out of one end of the cylindrical tube and are connected to a suitable power source. Such non-rotatable heater element is designed to heat the entire length of the rotatable shaft and, by conduction, to also heat the ejector elements attached thereto during predetermined time intervals over a cycle of the operation of the ice piece maker, thereby releasing the ice pieces from the ejector elements as full deeply notched leading (primary) crescent shaped ice pieces which are then, upon impact with ice piece stripper elements positioned to impede the rotation of said ice pieces, forced away from the primary ejector fingers during the rotation of the shaft.

Each of said plurality of primary ejector elements extends into one of the crescent shaped cavities at the beginning of a cycle to substantially divide such crescent shaped cavity into two half crescent shaped cavities, and therefore to divide the ultimately formed full crescent shaped ice pieces into two half crescent shaped ice pieces, with each ejector element of the row of primary ejector elements being simultaneously heated and rotated in a first direction about the radial axis of the arcuately shaped tray until the rotating ice pieces impact the stripper elements to impede the rotation thereof and thereby strip the full crescent shaped ice pieces from the primary ejector elements which continue to rotate between adjacent stripper elements.

A feature of the invention is to form ice bridges between the two halves of each notched full crescent shaped ice piece of appropriate strength and dimensions and to heat the ejector elements sufficiently so that the notched, full crescent shaped ice pieces will first be released from the primary ejector elements so that they can subsequently be pushed away from, and completely off the ends of the primary ejector elements as full crescent ice pieces which will then fall into the collection bin where they will break into two half crescent ice pieces.

A second feature of the invention is to have the ejector elements longer than prior art ejector elements, with respect to the radius of the arcuately shaped elongated tray, to decrease the cross-sectional area (and therefor the strength) of the ice bridges between the half crescent shaped ice pieces of each full crescent shaped ice piece.

A third feature of the invention is the option of connecting of the heater element wire terminals to the same power source driving the rotatable shaft to cause the heater element to heat only when the rotatable shaft is rotating, thereby conserving energy and cycle time.

A fourth feature is the use of stripper elements which have the general configuration of an inverted "V" with the rising slope thereof being impacted by the leading edge of the rotating full, crescent shaped ice piece and subsequently pushed upwardly by the primary ejector elements which continue to rotate in between and past the stripper elements until the full crescent ice pieces are pushed over the peak of the inverted "V" shaped stripper elements and onto the descending slope of the stripper elements so that the full crescent ice pieces will then slide down such descending slopes out of the freezing tray and then drop into the collection bin where they will break into separate half crescent shaped ice pieces.

Each of the ejector elements has a width "c" which is slightly less than the distance "b" between adjacent stripper elements, with the distance "b" being less than the width "a" of an ice piece (and the distance between separators), to allow the ejector elements, but not the ice pieces, to pass between adjacent stripper elements, and to form second ice bridges between the two half crescent shaped ice pieces of each full crescent shaped ice piece. The stripper elements are positioned to divert the leading and lagging rows of half crescent shaped ice pieces outside of the arcuately shaped tray as intact full crescent shaped ice pieces.

III. BRIEF DESCRIPTION OF THE DRAWINGS

The above and other objects and features of the invention will be more fully understood from the following detailed description thereof when read in conjunction with the drawings in which:

FIG. 1 is a partially broken away isometric view of the invention;

FIG. 1*a* shows a detailed and enlarged partially broken away view of the rotating ejector assembly and the heater element which extends virtually along the entire length of the rotatable shaft and functions to heat the rotatable shaft and the attached ejector elements at predetermined times;

FIG. 1*b* shows a detailed and enlarged view of the non-rotatable heater unit which fits inside the rotatable shaft;

Figure 5C:
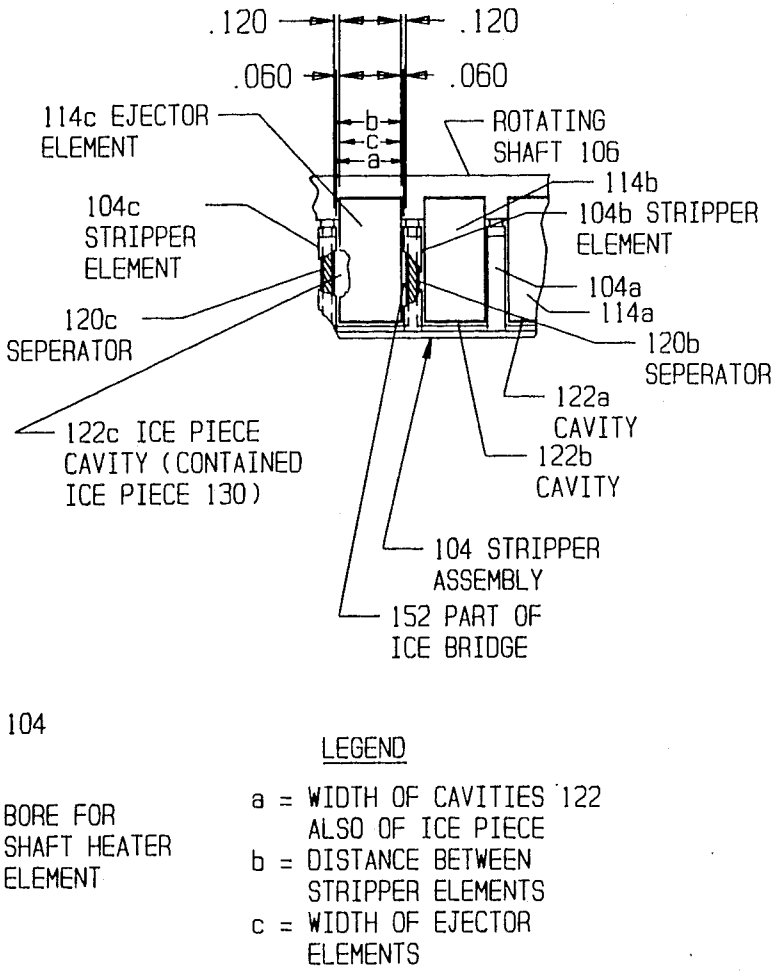
Figure 5B:
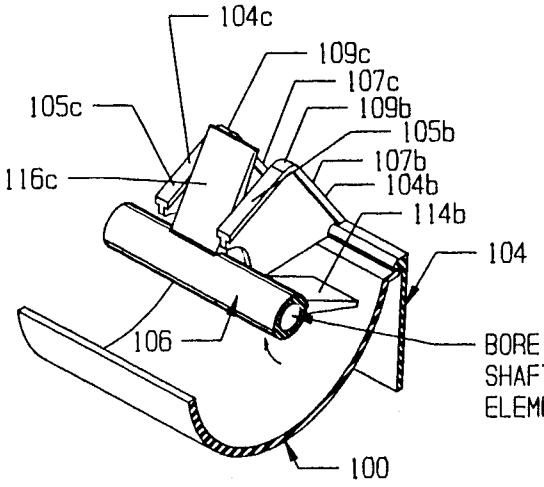
Figure 5A:
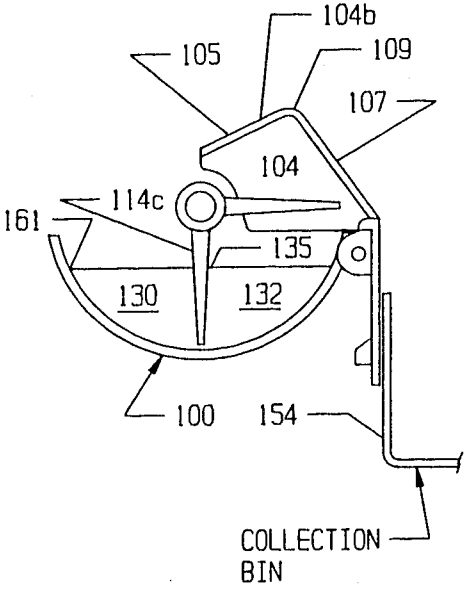
Figures 5, 6, 7, 8, 9:
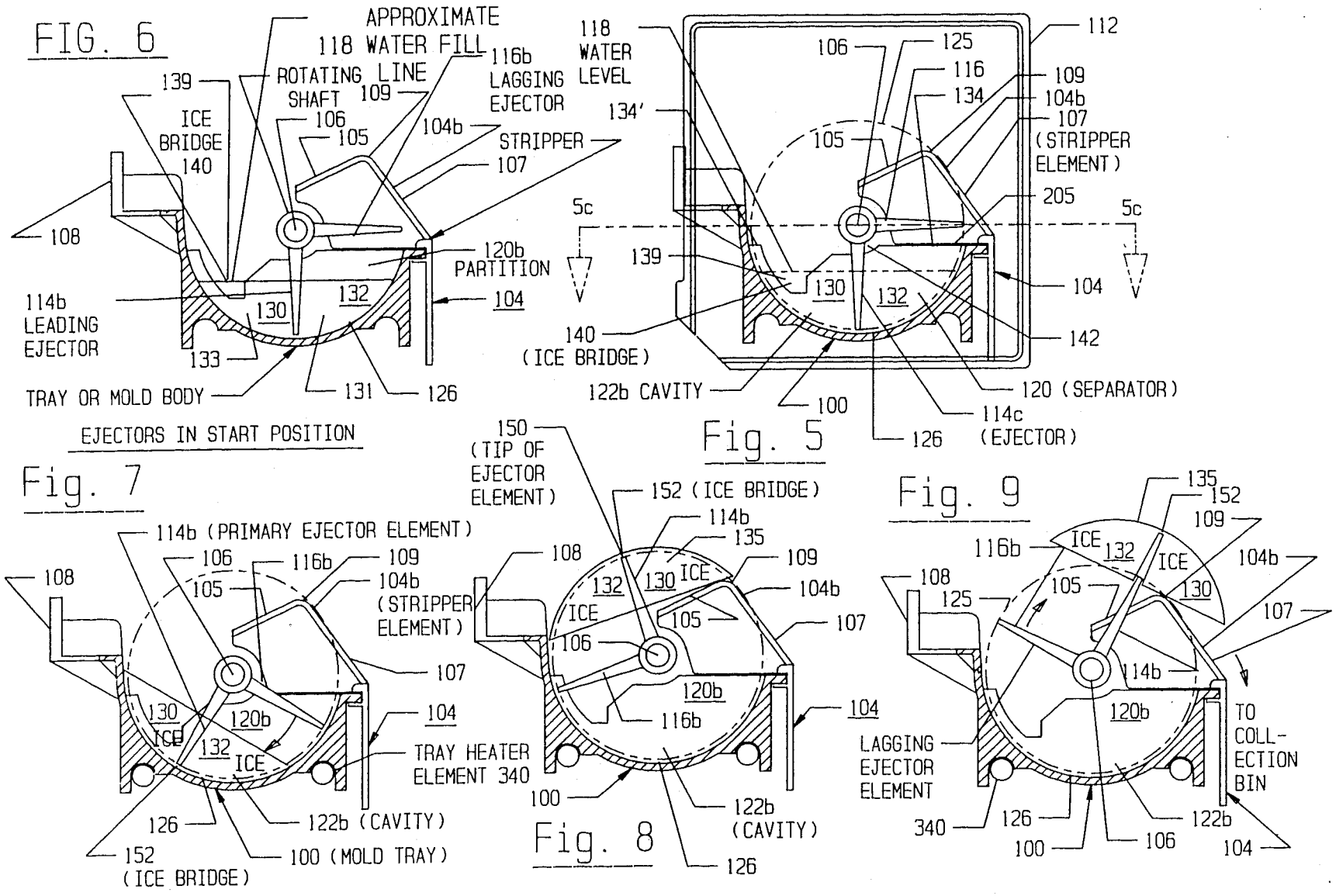
Figure 12:
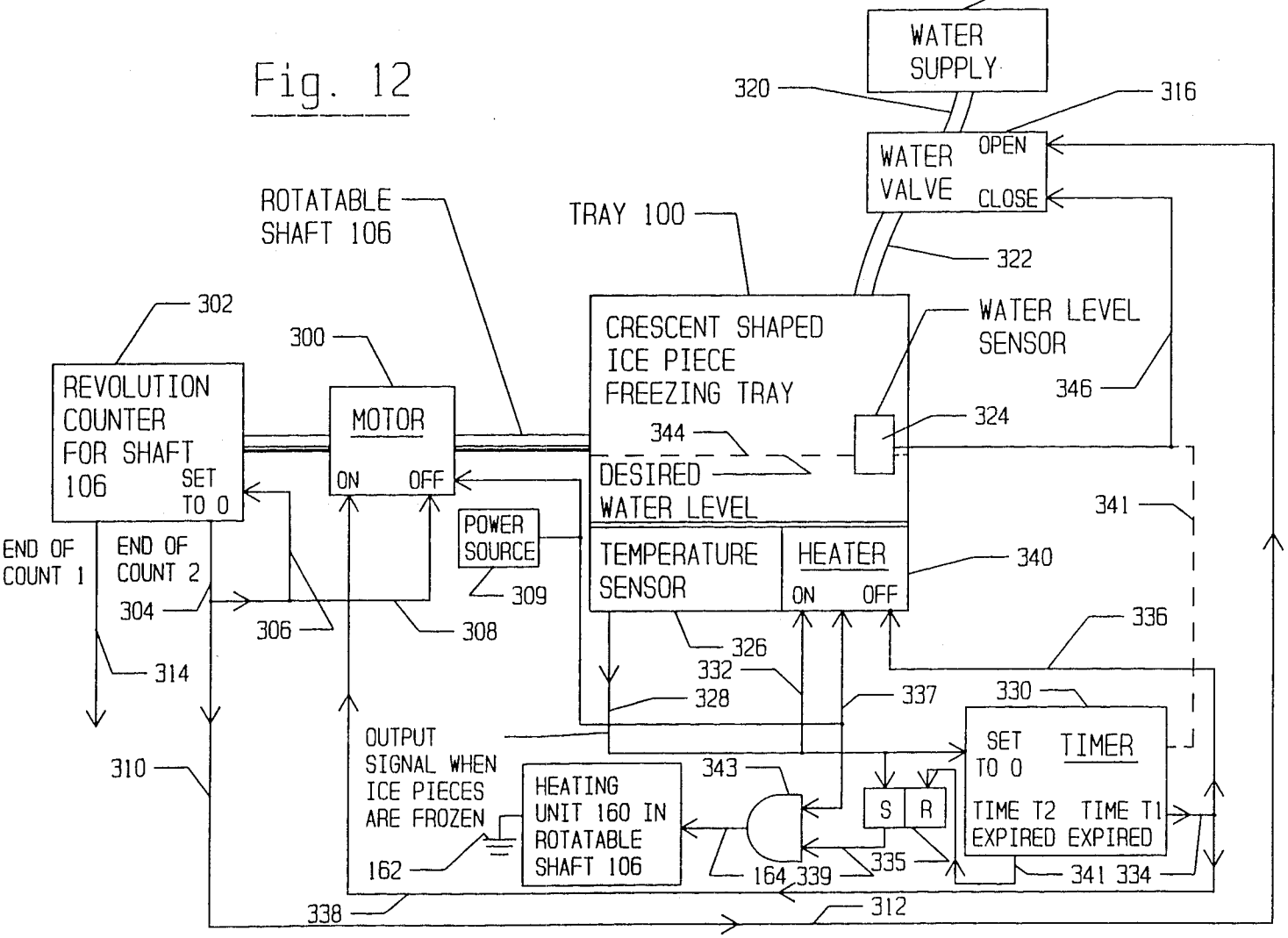

FIG. 5*a* shows a side view of a stripper element;

FIG. 5*b* shows an enlarged view of the leading ejector element passing between a pair of stripper elements;

FIG. 5*c* is a partially cross-sectional view of FIG. 5 to illustrate more clearly the spatial relation between the first (primary) ejector elements, the separators, the rotating shaft, the ice pieces, and the ice bridges formed between the leading and lagging half crescent ice pieces of a full crescent shaped ice pieces;

FIG. 5 is a cross-sectional view of the half crescent shaped ice piece maker including the casing for the controls and the motor drive, the ice piece forming tray, an ice piece ejector element, an ice piece separator, and an ice piece stripper element, with the single ice piece ejector element and the single ice piece stripper being representative of one element only of the entire ice piece ejector assembly and the ice piece stripper assembly;

FIGS. 6–11 show the sequence of operation of the invention wherein both the leading and lagging half crescent shaped ice pieces are unfrozen from the ejector elements simultaneously as one solid full crescent shaped ice piece and then broken into half crescent shaped ice pieces by the impact thereon as they fall into the collection bin;

FIG. 12 shows a functional diagram of the control logic which controls the sequence and order of steps required to manufacture half crescent shaped ice pieces in the present invention.

In order to facilitate the reading of this specification the following outline of the subject matter therein is set forth below:

I—BACKGROUND OF THE INVENTION
II—OBJECTS AND BRIEF STATEMENT OF THE INVENTION
III—BRIEF DESCRIPTION OF THE DRAWINGS
IV—DESCRIPTION OF THE BASIC FORM OF THE INVENTION (FIGS. 1–5)
V—DESCRIPTION OF THE OPERATION OF THE INVENTION (FIGS. 6–11)

IV—DESCRIPTION OF THE BASIC FORM OF THE INVENTION (FIGS. 1–5)

In describing the invention a general description of the partial, broken away isometric view of FIG. 1 will first be described to familiarize the reader with the general structural and operational relationship of the main parts of the invention including the arcuately shaped, elongated and compartmentalized tray 100 of FIG. 2, the ejector element assemblies 114 and 116 of FIG. 3, the non-rotating heating element of FIGS. 1*a* and 1*b* positioned within the rotatable shaft 106, and the stripper assembly 104 of FIG. 4.

Next, each of the above-mentioned main parts of the invention will be described individually followed by a detailed description of the operation of the invention, as shown in FIGS. 6–11.

Throughout the specification all of the figures similar parts are identified by the same reference character. It is to be noted, however, that the total ejector assembly 102 of FIG. 3 has pluralities of similar elements such as the two groups of ejector elements 114 and 116, which are identified individually by reference characters 114*a*, 114*b*–114*h*, and 116*a*, 116*b*,–116*h*.

Similarly all of the same elements listed below are identified collectively by a single reference character, as indicated:

1—The stripper elements by reference character 104.
2—The rising slopes of the stripper elements by reference character 105.
3—The descending slopes of the stripper elements by reference character 107.
4—The peaks between the rising and descending slopes of the stripper elements by reference character 109.
5—The full crescent shaped cavities in the freezing tray by reference character 122.
6—The notched, full crescent shaped ice pieces by reference character 135.
7—The leading half crescent shaped ice piece by reference character 130.
8—The lagging half crescent shaped ice pieces by reference character 132.

In some instances it will be necessary to identify a specific single one or more of any of the above-listed elements. For example it might be desired to cite only two of the ejector elements 114. To accommodate such a need the ejector elements 114 are individually and consecutively identified as ejector element 114*a*, ejector element 114*b*, ejector element 114*c*, etc., as shown in FIG. 3.

Figures 1, 2, 3, 4:
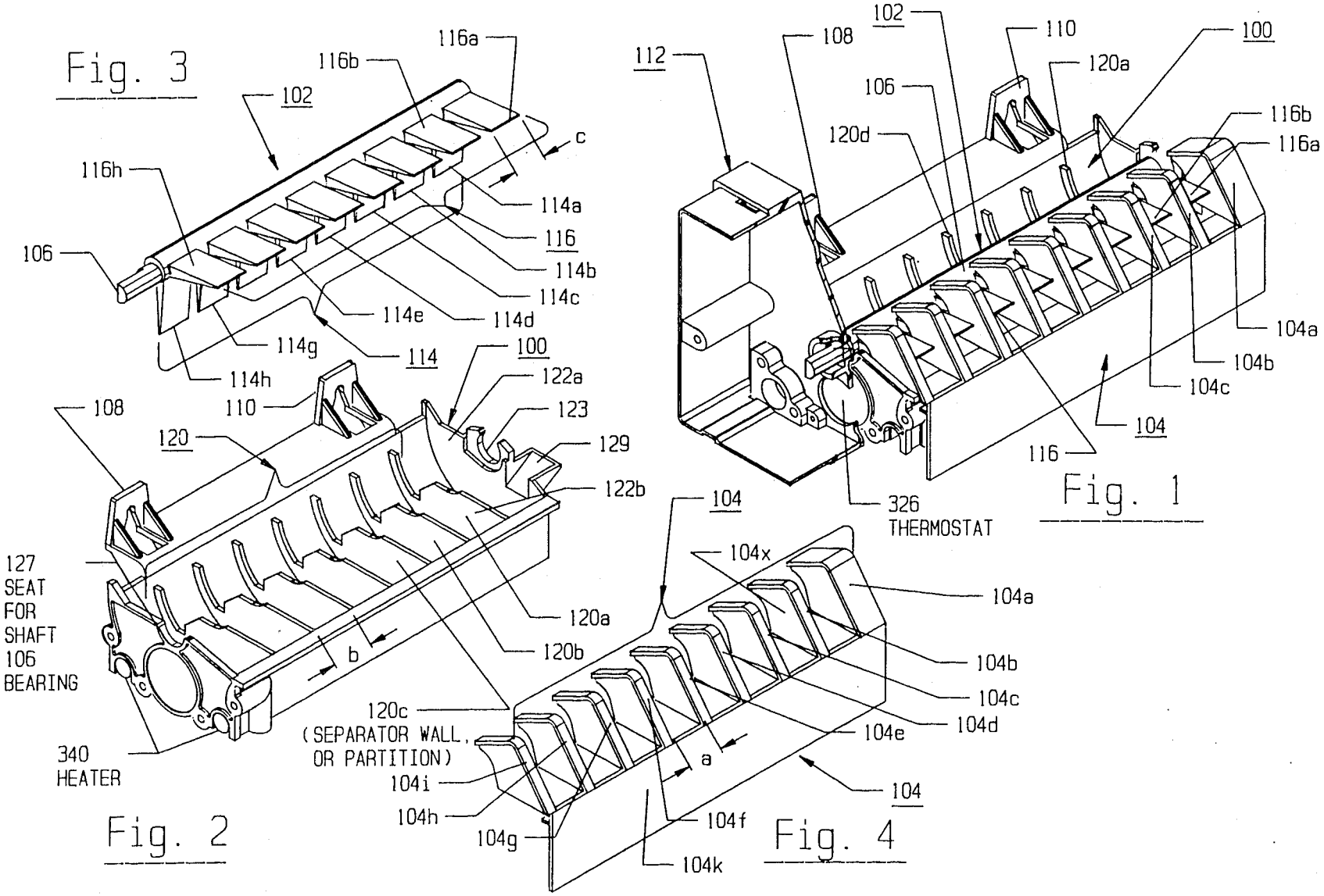
FIG. 2 is an isometric view of the arcuately shaped freezer tray.
FIG. 3 is an isometric view of the ice piece ejector element assembly.
FIG. 4 is an isometric view of the ice piece stripper assembly.

Similarly, stripper elements 104 are individually identified as stripper element 104*a*, stripper element 104*b*, stripper element 104*c*,–stripper element 104*i*, as shown in FIG. 4.

Referring now specifically to FIG. 1 and ice piece freezer tray or mold 100, shown separately in FIG. 2, has rotatably secured, with respect thereto, an ejector element assembly 102, shown separately in FIG. 3 and comprising a rotatable hollow shaft 106 (shown separately in FIGS. 1*a* and 1*b*) having two sets of somewhat similarly shaped ejector elements 114 and 116 (see FIG. 3) secured thereto and functional rotatable to eject the notched, unitary, full crescent shaped ice pieces 135 from the crescent shaped cavities 122 in the tray 100

Figure 11:
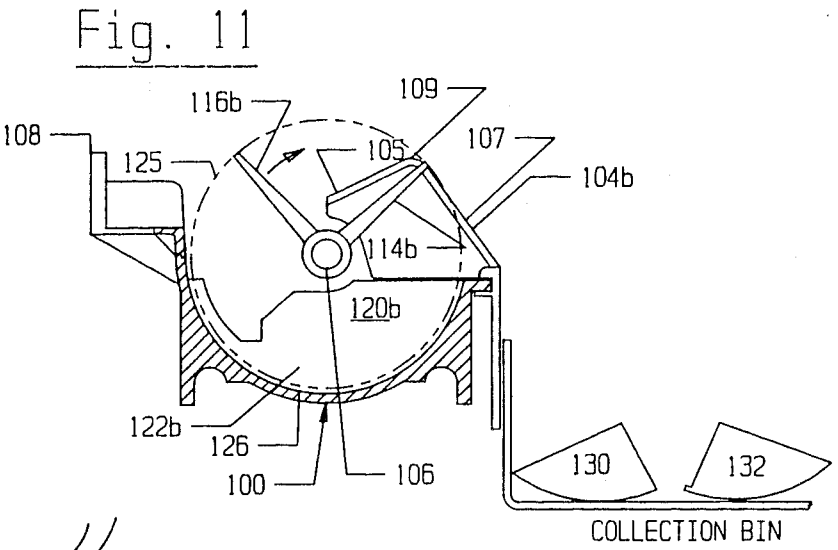

(shown separately in FIG. 2) in which they were formed, and ice piece stripper elements 104 each having a rising slope 105 (see FIG. 5) for initially impeding the full crescent shaped ice pieces as they are rotated to move said full crescent shaped ice pieces upwardly and away from the ejector elements 114 and onto the descending slope of the stripper elements 104 contiguous with said rising slopes 105 to form peaks 109 between the rising and descending slopes of the stripper elements 104 so that the still intact full crescent shaped ice pieces will slide down said descending slopes 107 and into a collection bin 154 of FIG. 11.

The impact of the rotating but still unified notched full crescent shaped ice pieces 135 upon the rising slopes 105 of the stripper elements 104 occurs after the rotatable shaft has rotated about 180° as shown in FIG. 8.

As shown in FIGS. 8, 9, 10, and 11 the still intact full crescent shaped ice pieces 135 ride up the rising slopes 105 of strippers elements 104 and over the peaks 109 thereof until they are completely clear of the rotating elements 114 and the full crescent shaped ice pieces will then finally slide down the descending slopes 107 of the stripper elements 104 into the collection bin 154 shown in FIG. 11.

However, as mentioned above, an unwanted force tending to break the full crescent ice piece into two half crescent ice pieces before being ejected into the collection bin 154 is generated by the freezing of the crescent ice pieces to the ejector element 114 so that the full crescent shaped ice piece will not easily slide off the ejector element 114.

The aforementioned problem is virtually eliminated in the present invention by heating the rotatable shaft 106 by a non-rotatable heating element 160 (FIGS. 1*a* and 1*b*) extending within and along the length of the rotatable shaft 106 and thus also heating the ejector elements 114 and 116 to melt the ice bond 152 (FIG. 5*c*) between the ice pieces and the ejector elements 114. The ice pieces will thereafter move away from the ejector element 114 as full crescent ice pieces with ease.

A principal purpose for providing rising and descending slopes 105 and 107 and the peak 109 on stripper elements 104 is to lift the still intact ice pieces away from the heated ejector elements 114 as quickly as possible to avoid as little melting as possible on the surface of the full crescent ice pieces.

Figure 1B:
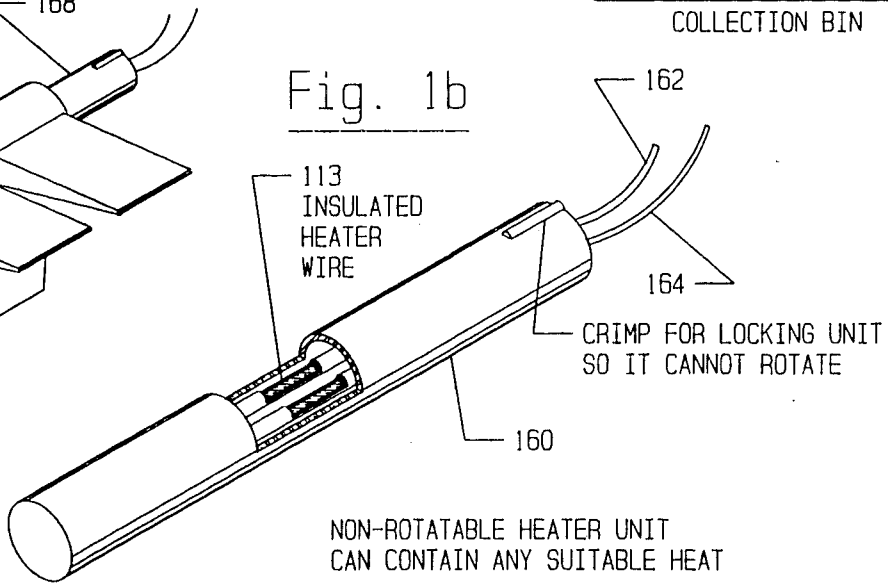
Figure 1A:
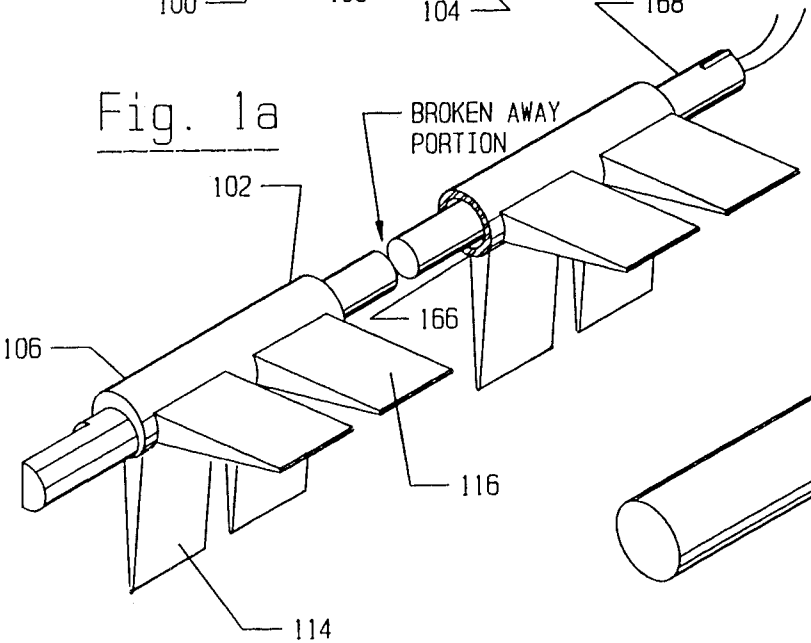

The heater element 160 is shown separately in FIG. 1*b* as a cylindrically shaped element which fits inside a bore 166 formed inside the hollow rotatable shaft 106 and, when controllably energized by a power source, will heat the rotatable shaft 106 and the ejector elements 114 and 116 during a predetermined interval of time, including at least part of the time the rotatable shaft 106 is rotating, up to about the time the still intact notched full crescent shaped ice piece 135 impacts the rising slope of the stripper elements as shown in FIG. 9.

The heater assembly 160 of FIG. 1*b* can employ any one of several different types of heaters. More specifically, the heater assembly can be a non-rotatable Calrod unit in the form of an electrically insulated cylinder which fits inside the hollow cylindrical shaft 106. The Calrod heater unit is non-rotatable to avoid the expensive necessity of providing slip rings to supply heating power to the Calrod unit 168.

Alternatively the heater assembly can consist of a second, hollow non-rotatable tubular element 160 which fits inside the bored out rotatable hollow shaft 106. An insulated Nichrome wire 133 folded back upon itself is inserted within the second hollow tubular element 160 so that said folded-back Nichrome wire extends past all of the ejector elements 114 and 116 secured to said hollow shaft 106 and, by conduction when energized, will heat all of said ejector elements 114 and 116 to melt the strong ice bond between the ejector elements 114 and 116 and the notched, full crescent shaped ice pieces 135 before such ice pieces 135 impact upon the rising slopes 105 of said stripper elements 104. In FIG. 1*b* the terminals 162 and 164 can represent the terminals of either the Nichrome wire or the Calrod unit.

The heating element can be energized after the notched, full crescent shaped ice pieces are fully frozen to a desired temperature, or at the time the rotatable shaft begins to rotate, or at any suitable time which will enable the notched, full crescent shaped ice pieces to melt free of the ejector elements 114 and 116 before the full crescent ice pieces impact against the rising slope 105 of the stripper elements, as shown in FIG. 9.

The beginning and length of the heating period is dependent upon a number of design parameters including the wattage of the heater element, the thermal conductivity of the rotating shaft and the ejector elements 114 and 115, the angular velocity of the rotating shaft, and the temperature of the frozen ice pieces.

The same power source 309 (FIG. 12) utilized to energize the motor 300 which rotates the hollow rotatable shaft 106, can also be employed to supply power to the heater element leads 162 and 164 (FIG. 12), all under the control of timer mechanism 330, shown generally in FIG. 12.

In the particular embodiment of the invention shown and described herein the two sets of ejector elements 114 and 116 shown generally in FIG. 3 lie in common planes which are spaced about 90° apart, as shown in FIGS. 3 and 5–11.

The set of ejector elements 114, which are defined herein as the leading (primary) set of ejector elements are the ejector elements which extend into the water (in cavities 122) being frozen into full crescent shaped ice pieces with a notch in the center thereof caused by the primary ejector elements 114 being inserted therein during such freezing.

For purposes of discussion the leading (primary) row of ejector elements 114 will be defined as being at 0° (6:00 o'clock in FIGS. 5 and 6) during the freezing of the half crescent ice pieces and will subsequently be rotated by rotatable shaft 106 in a clockwise direction.

The lagging row of ejector elements 116, during freezing of the full crescent shaped ice pieces, is initially positioned as shown in FIG. 3, which is about 90° in a counter clockwise direction from ejector elements 114 during freezing of the ice pieces and before rotation of shaft 106 thereof has begun.

Thus, when shaft 106 begins to rotate through a cycle, as shown in FIGS. 6–11, the leading row of ejector elements 114 and the stripper elements 104 will coact to push the intact and notched full crescent shaped ice pieces 135 away from the rotating leading primary ejector elements 114, out of the freezing tray 100, and into the collection bin 154 (FIG. 11) while the lagging row of ejector elements 116 will follow the leading row of ejector elements by 90° and will sweep up any half crescent ice pieces which have prematurely broken off any unitary full crescent shaped ice pieces and fallen backwards in a counter-clockwise direction onto the lagging row of ejector elements 116. In this manner no prematurely broken off ice piece can fall into the bottom of the freezing tray and interfere with the production of the next full tray of ice pieces.

Further, in FIG. 1, a set of brackets 108 and 109 are provided to secure the freezing tray 100 of the ice maker assembly to a vertical side wall, (not specifically shown) of a freezer.

A control mechanism (shown generally in FIG. 12) is contained within a control mechanism housing 112 of FIG. 1, and functions generally to first rotate the shaft 106, (FIG. 3) containing the newly frozen full crescent shaped ice pieces which are frozen onto the leading row of ejector elements 114, as shown in FIGS. 6 and 7, a full 360° and, as discussed briefly above, cause the leading edge of the still intact notched full, crescent shaped ice pieces 135 to finally impact the rising slopes 105 of the stripper elements 104 (see FIG. 8) and then, by virtue of the continuously rotating ejector elements 114, cause the intact half crescent ice pieces 135 to be pushed upwardly and away from the heated ejector elements 114, over the peaks 109 of the stripper elements 104 onto the descending slopes 107 of the stripper elements, and down into the collection bin 154.

The rotatable shaft is supported generally at one end on a cam mounting (not shown in FIG. 2 but shown in prior art U.S. Pat. No. 3,362,181 to Linstromberg) to align the axis of shaft 100 with the radial axis of the freezer tray 100 of FIG. 2 within the prime mover and control mechanism housing 112 (FIG. 1), and at the other end on a bearing (not shown) on the fill cup 129, also shown generally in FIG. 2.

The individual elements of the two sets of ejector elements 114 and 116 preferably are formed integrally with the hollow rotatable shaft 106 for better conduction of heat throughout the entire assembly of shaft 106 and ejector elements 114 and 116 which are made of a material with a high coefficient of thermal conductivity such as aluminum, plastics, or other materials.

The relative positions of the two sets of ejector elements 114 and 116, from their initial position after water has been injected into tray 100 to level 118 (see FIG. 5) and then frozen into full crescent shaped ice pieces, as such ejector elements 114 and 116 are rotated through 360° are shown representatively in the cross sectional views of a selected one of the cavities in FIGS. 6–11.

As discussed generally above, each of the primary ejector elements 114 extends downwardly from the shaft 106 into the approximate center of one of the water filled (to level 118) crescent shaped cavities 122 (see FIGS. 5 and 6) which is bounded by adjacent vertical separators or partitions 120 on either side thereof and by the arcuately shaped inner surface of the tray 100, and which, when frozen, will form a full crescent shaped ice piece. Thus, each of the primary ejector elements 114 divides each of such cavities 122 into two half crescent shaped cavities within each cavity to form a full crescent shaped ice piece connected together by an ice bridge 152 since the ejector elements 114 do not completely close off the leading crescent shaped cavity from the lagging half crescent shaped cavity.

In summary, the crescent shaped ice pieces are formed with the set of ejector elements 114 immersed therein to almost, but not completely, divide the full crescent shaped ice pieces into two half crescent shaped ice pieces.

The second set of ejector elements 116 extends outwardly to the right from shaft 106 in FIG. 5 and are positioned over the water level 118. As mentioned above, the angular distance from the lagging ejector elements 116 to the leading ejector elements 114, measured in a clockwise direction of rotation is 75° to 90°. The shaft 106, and therefore both sets of ejector elements 114 and 116, rotate in a clockwise direction, but only after the crescent shaped ice pieces have become frozen in their respective crescent shaped cavities.

As an alternative, if desired, the set of ejector elements 114 can be designed to be positioned in their crescent shaped cavities at selected angular distances on either side of the position shown in FIG. 5 to divide the full crescent shaped ice piece into two unequal portions of the initially full crescent shaped ice piece. As the shaft 106 and the two sets of ejector elements 114 and 116 are rotated through 360° the resulting full crescent shaped ice pieces are dumped into an external collection bin 154 (FIG. 11) and, upon impact with the collection bin, will break into two sets of different sized partial crescent shaped ice pieces, with each set of ice pieces being either slightly greater or slightly less in size than the half crescent ice pieces formed by the positioning of the ejector elements 114, as shown in FIG. 5.

The paths of the tips of the rotating sets of ejector elements 114 and 116 can, if desired, be the same and are represented by the dashed line circle 125 in FIGS. 5–11, which sweeps close to, but does not contact, the arcuately shaped bottom 126 of the tray 100.

It is important to note that there must be a bridge of ice 152 (see FIGS. 7 and 8) connecting the two half crescent ice pieces 130 and 132 (of a single full crescent shaped ice piece) of FIGS. 6–11 in each of the cavities 122, and on either side of an ejector element 114 since this bridge of ice 152 around ejector element 114 that connects the lagging half crescent shaped ice piece 132 to the leading half crescent shaped ice pieces 130 helps to hold the leading and lagging ice pieces together as full crescent shaped ice pieces as the leading half crescent shaped ice pieces 130 are rotated by the primary ejector elements 114 in a clockwise direction around the rotating shaft 106 which is being rotated by a suitable drive mechanism. The area where the bridge 152 is formed is also necessary to fill the cavities with water.

As mentioned generally above, the width "c" of the ejector elements, such as ejector element **114*b* (FIGS. 7 and 8) is slightly less (typically 0.170") than the width "a" of cavity 122*b*, in which the ejector element 114*b* is initially inserted. Therefore, the ice bridge 152 is formed around the sides and outer tip 150 of each ejector element 114*a*–114*h* which joins the rotatively lagging half crescent ice pieces 132 to the leading half crescent ice pieces 130 of the same full crescent ice pieces. It should be noted that the both the leading and lagging rows of half crescent ice pieces are also initially frozen to the leading ejector elements 114. Thus, when the leading half crescent ice piece 130 (see FIGS. 6–11) is rotated by the ejector element 114*b* the lagging half crescent ice piece 132 (see FIGS. 6–11) will follow the leading half crescent shaped ice piece 130**.

Referring now to FIG. **5*a* there is shown a side view of a stripper element. The leading edge 161 of the leading half crescent ice piece 135 will impact the rising slope 105 of the stripper element 104 as ejector element 114*c* is rotated. Because the ejector element 114*c* (see FIG. 5*b*) can pass through the adjacent stripper elements 104*b* and 104*c* whereas the ice piece 130 cannot, the ice pieces 130 will cease rotating and be pushed up the rising slopes 105*b* and 104*c* of strippers 104*b* and 104*c* when such ice pieces 130 impacts the stripper elements 104***b* and 104*c* while the ejector element 114*c* will continue to rotate between the adjacent stripper elements 104*b* and 104*c*.

As ejector element 114*c* continues to rotate the ice pieces 130 and 132 will, as a single, unitary full crescent ice piece be pushed over the peaks 109*b* and 109*c* of stripper elements 104*b* and 104*c* and then slide down the descending slopes 107*b* and 107*c* of strippers 104*b* and 104*c* into the collection bin shown in FIG. 11.

Reference is now made to FIG. 5*c* which shows the relationship between the width dimensions of the ice pieces, the ejector elements 114, and the distance "b" between adjacent stripper elements 104, all of which enable the stripper elements 104 to strip the full crescent shaped ice pieces from the leading ejector elements 114 and push them over the stripper elements and into the collection bin while allowing the ejector elements to pass between the stripper elements.

In FIG. 5*c* adjacent separators 120*b* and 120*c* determine the width "a" of the crescent shaped ice piece cavity 122*c* (actually the same width as the ice piece no longer in the freezer tray) which can be seen to be greater than the distance between the adjacent stripper arms 104*b* and 104*c* by 0.140" (0.07" on each side of the ice piece 130) (also see FIG. 12).

The width "c" of ejector element 114*c* is less than the width "a" of ice piece cavity 122*c* by 0.170" (0.085" on each side of the ejector element 114*c*), and less than the distance "b" between separators on each side of the ejector element 114*c* by 0.03". Thus, while the ejector element 114*c* will pass through adjacent stripper elements 104*b* and 104*c* in FIG. 5*a* by 0.030" on both sides of ejector element 114*c*, the full crescent shaped ice piece, having the width "a" of cavity 122*c*, will have been intercepted by the adjacent stripper elements 104*b* and 104*c* by 0.070" on both sides of the ice piece to stop the rotation of the ice piece 151. However, the ejector element 114*c* will have continued to rotate to push the full crescent shaped ice piece 130 outwardly from the rotating shaft 106 to which the ejector element 114*c* is rigidly attached, as discussed above, and along the inverted "V" shaped top surfaces of the adjacent stripper elements 104*b* and 104*c* and ultimately outside the tray mold cavity 122*b* and into a collection bin 154 (see FIG. 11). An ice bridge 152 is formed between the leading and lagging rows of half crescent shaped ice pieces 130 and 132 in the space between the edges of ejector element 114*c* and the separators 120*b* and 120*c*. Such ice bridge holds the leading and lagging rows of half crescent ice pieces together as they are rotated by heaters shaft 106 onto stripper element 104 and finally out of the freezing tray 100 as a full crescent shaped ice piece.

Referring now to FIG. 5 the separator 120 has a lowered portion 139 therein, which allows water to flow from one cavity to the next, thereby filling all of the cavities 122 with water to the desired level 118. Ice bridges 140 are also formed between adjacent leading half crescent shaped ice pieces. These ice bridges 140 join together all of the leading half crescent shaped ice pieces into a solid row 130 of leading half crescent shaped ice pieces which tend to keep the crescent shaped ice pieces together as they are rotated. The ice bridges 152 of FIG. 5*a* mentioned above, hold together the lagging row 132 of half crescent shaped ice pieces and the leading half crescent shaped ice pieces as the full crescent shaped ice pieces 135 are rotated by the ejector elements 114.

While it is unlikely that any half crescent shaped ice pieces will break off the full crescent shaped ice piece prematurely during rotation thereof and fall back into the tray 100, such an event can occur. In such event the ice maker is designed so that the lagging row of ejector elements will sweep any such stray ice pieces out of tray 100 and into the external collection bin 154.

Typical dimensions of various parts of the ice maker are as follows:

1—Length of ejector elements—1.40"
2—Width of leading and lagging ejector elements respectively—0.71" and 0.60"
3—Thickness of ejector elements near shaft 106 and at tips thereof respectively—0.12" and 0.060"
4—Diameter of shaft 106—0.265"
5—Width of top of stripper element—0.203"
6—Width of stripper element support element—0.08"
7—Length of row of stripper elements—7.00"

The shaft 106 and the ejector 114 and 116 can be an integral unit formed of a plastic having a high coefficient of thermal conductivity or any other suitable material which will allow the leading ejector to perform the functions set forth above.

V. DESCRIPTION OF THE OPERATION OF THE INVENTION (FIGS. 6–11)

In a preferred form of the invention, whose operation is shown generally in FIGS. 6–11, both the leading and lagging half crescent shaped rows of ice pieces, after being unfrozen from the heated ejector elements, are usually ejected from tray 100 as a single, large mass of ice with adjacent half crescent shaped ice pieces in the leading row of half crescent shaped ice pieces being joined together by the first ice bridges 140, as shown in FIGS. 5 and 6, and with the leading row 130 of half crescent shaped ice pieces and the lagging row 132 of half crescent ice pieces of each full crescent ice pieces being joined securely together by the above mentioned second ice bridges 152 shown in FIGS. 5*a* and 6–11, which have a strength sufficiently great to hold together the leading and lagging rows of ice pieces 130 and 132 as they are swept out of the freezer tray 100, over the stripper elements 104 and into the collection bin 154. The strength of ice bridges 152 can be determined by decreasing the width of ejector elements 114 by 0.010" to 0.020" while leaving the remaining width dimensions unchanged.

Figure 10:
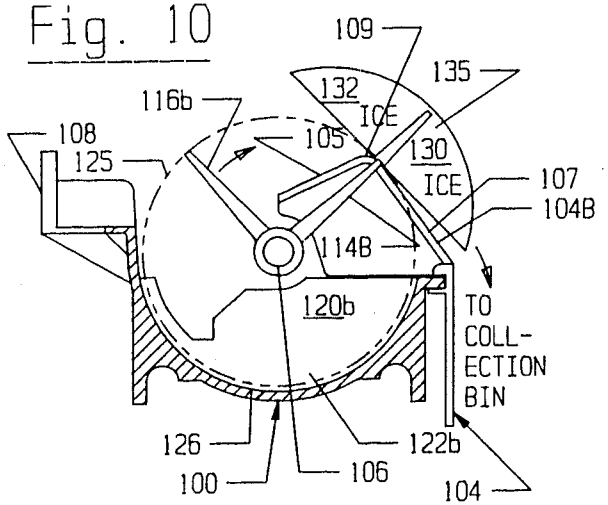

More specifically, as the heated leading ejector elements 114 continue to rotate, the leading row 130 of half crescent shaped ice pieces will impact the rising slope 105 of stripper element 104*b* as shown in FIG. 8 and will no longer be able to rotate with shaft 106 but instead will be forced to move upwardly and outwardly along the leading ejector elements 114 and unto the rising slopes 105 of stripper elements 104, as shown in FIGS. 9–11, which will also cause the lagging row 132 of half crescent shaped ice pieces, at this time still rigidly attached to the leading row 130 of ice pieces by ice bridges 152 to move upwardly and outwardly on the row of leading ejector fingers 114, also as shown in FIGS. 9–11.

FIG. 10 shows the leading and lagging rows of half crescent shaped ice piece, still rigidly attached to each other by ice bridges 152 (see FIGS. 5*a*, 9 and 10) immediately after they have been pushed over the edge of the stripper assembly 104 and towards the external collection bin 154. As the solid chunk of ice consisting of the two rows of half crescent ice pieces falls into the collection bin 154 as shown in FIG. 11, the impact of the fall will cause the solid chunk of ice to break up into individual half crescent shaped ice pieces. While the ice bridge 152 must hold the leading and lagging half crescent ice pieces together as a full crescent shaped ice piece until it falls into the collection bin 154 and thereby breaks into two half crescent ice pieces, such ice bridges 152 are not sufficiently strong to prevent the notched, full crescent ice pieces from breaking apart upon impact with the collection bin 154.

Referring now to the prior art U.S. Pat. No. 3,362,181 issued Jan. 9, 1968, to Linstromberg there is shown in FIGS. 3, 4, 5, 7, 11 of Linstromberg a control mechanism including sensors, a motor, and motor drive means responsive to signals from the sensors to operate the required sequential operating steps of the present invention. More specifically Linstromberg shows and describes a motor drive arrangement, including a driving motor 204 in columns 8 and 9 of Linstromberg for providing the torque necessary to rotate the shaft 189 of FIG. 5 of Linstromberg and therefore also rotate the ejector elements 188 of FIG. 4 of U.S. Pat. No. 3,362,181 to eject the crescent shaped ice pieces formed in the freezing tray mold 126 (FIG. 1 of Linstromberg) in response to a signal generated by thermostat 254 of Linstromberg. The rotation of shaft 189 of U.S. Pat. No. 3,362,181 also activates the control means for sequentially operating the various processing steps for the ice maker of Linstromberg such as injection of water into the freezing tray, freezing the ice pieces, heating the freezing tray, and beginning and terminating the rotation of shaft 189.

The ejector assembly 131 of Linstromberg is arranged to operate at a low torque permitting the use of plastic parts in the drive and ejector structure and providing improved safety of operation.

More specifically, the various sequences of operation of Linstromberg include injecting a measured and time controlled amount of water into the freezing mold 126 of Linstromberg as described in columns 9, 10, and 11 thereof freezing the water to a desired temperature as described in columns 5 and 6 of Linstromberg, heating the mold 126 to release the frozen full crescent shaped ice pieces therefrom to permit the full crescent shaped ice pieces to be pushed out of the freezing tray 126 by the rotating ejector elements described in columns 6 and 7 of Linstromberg, then stripping from the ejector elements 131 by the stripper 208 (FIG. 4) thereof, and finally dumped into an ice piece receiving bin 119 (see FIG. 1 of Linstromberg).

The control mechanisms shown in FIGS. 7 and 11 Linstromberg are driven by motor 204, as mentioned above, to orchestrate the sequences of operational steps of the Linstromberg's full crescent shaped ice piece maker and prepare the ice maker control means of FIGS. 7 and 11 for the freezing and ejection of the next batch of ice pieces.

The entire torque generating means (including the motor 204 of U.S. Pat. No. 3,362,181) and the entire control structure for initiating and terminating all of the operational steps in the initiating and terminating all of the operational steps in the proper sequences and at the proper times, of Linstromberg can be and are employed in the present invention, although only generally described herein. Accordingly, the entire driving and control structure of Linstromberg as well as any other structure thereof required to drive the rotating shaft 106 of the present invention and to initiate and terminate all of the steps necessary to repeatedly form half crescent shaped ice pieces at the proper times and in the proper sequence, is hereby incorporated by reference in the present specification.

Referring now to FIG. 12 there is shown a diagram of one form of typical logic of the present invention which can perform the necessary sequential steps of the operation of the ice maker through the cycle (which can be 360° or 720°) required to make half crescent-shaped ice pieces. It is to be understood that the structure of the U.S. Pat. No. 3,362,181 to Linstromberg provides a much more detailed showing and description of another, arrangement of controls which could be employed to perform the sequential steps necessary to make the ice pieces, although one of ordinary skill in the art could construct suitable controls from the general diagram of FIG. 12 without departing from the spirit or scope of the present invention.

In FIG. 12 assume that a cycle of ice piece making has just been completed and the motor 300 has been turned off at the end of a 360° revolution of shaft 106 by the output 308 of counter 302 which will be reset to zero via lead 306 for the next cycle of operation and the water valve 316 will be opened via lead 312 to permit water to flow from water supply 318, through pipe 320, open water valve 316, and pipe 322 into the cavities 122 of the freezing tray 100 (FIGS. 2 and 5).

When the water level in tray 100 reaches a level 344, which can be determined by timer 330 via lead 341 or a water level sensor 324, a signal will be supplied via lead 346 or lead 341 to close water valve 316 timer 330 and allow freezing of the water in tray 100 to begin.

A temperature sensor 326 can be employed to detect when the water in tray 100 is frozen to a desired temperature and will supply a signal via leads 328 and 332 to turn on heater 340 to heat the ice tray 100 and release the ice pieces therefrom, so that they can be ejected in the manner described in connection with FIGS. 6–11. The signal on lead 328 will also supply a signal via lead 328 to set timer 330 to zero from whence it will immediately begin to time a predetermined time period $T_1$.

At the end of such predetermined period of time, timer 330 will supply a signal via lead 334 to perform two functions; firstly to turn on and turn off the heater 340, and secondly to turn on the motor 300 to begin (and ultimately to terminate) the rotation of shaft 106, although not necessarily at the same time of, and thereby begin the ejection of the crescent shaped ice pieces from the tray 100.

A second heating element 160 (FIGS. 1*a* and 1*b*) is energized at time $T_2$ through AND gate 343 whose inputs are the power source 309 and the set output of flip-flop 335. Flip-flop 335 is set when temperature sensor indicates the ice piece has been frozen to a desired temperature. When counter timer 330 indicates a predetermined time $T_2$ sufficient to heat the ejector elements 114 to release the full crescent ice pieces therefrom the flip-flop 335 will be reset via lead 341 to disable AND gate 343 and thereby disconnect the power source 309 from heating element 113 or 168, to deenergize heating elements 113 or 168 of FIGS. 1*a* or 1*b*.

It is to be understood that the forms of the invention shown and described herein are but preferred embodiments thereof and that various modifications and other forms of the invention can be made by one of ordinary skill in the art without departing from the spirit or scope of the invention as defined in the appended claims.

I claim:

1. A method for making partial crescent shaped ice pieces comprising the steps of:

a—Injecting water into a row of crescent shaped ice cavities at least some of which are divided into two partial crescent shaped cavities by a set of rotatable ejector elements to form two rows of partial half crescent shaped water volumes;

b—freezing said partial half crescent shaped water volumes to form two rows of partial half crescent shaped ice pieces;

c—rotating said ejector elements by rotating a shaft to which said ejector elements are attached at one end thereof;

d—heating said shaft and thus heating said ejector elements while said shaft is being rotated to release the half crescent ice pieces from said shaft and said ejector elements while said shaft is rotating; and e—diverting said ice pieces from said shaft and said ejector elements and into a receiving receptacle.

2. A method as in claim 1 in which step "e" further comprises the steps of:

impeding further rotation of said bridged pairs of half crescent ice pieces by rising slopes of ice piece stripper elements to cause said rotating ejector elements to quickly push said ice pieces upwardly on said rising slopes and away from said heated ejector elements;

pushing said bridged pairs of half crescent shaped ice pieces past the peak of said rising slope of said stripper elements and onto a descending portion of said stripper element which enable the bridged ice pieces to slide over the edge of said tray and into a collection bin.

3. A method as in claim 1 in which step "d" further comprises the steps of:

forming said rotatable shaft to have a bore extending substantially along the entire length thereof;

inserting a heater element along the length of an elongated substantially cylindrical tube dimensioned to fit within the length of the bore of said rotatably shaft;

inserting said cylindrical heater containing tube within the bore of said rotatable shaft;

securing said cylindrical tube to be non-rotatable with respect to said rotatable shaft; and heating said heater element at predetermined times during an ice piece making cycle to in turn heat the cylindrical tube, the rotatable shaft and ejector elements to free the full crescent shaped ice piece comprising the bridge half crescent ice pieces from said ejector elements.

4. A method of making partial half crescent shaped ice pieces comprising the steps of:

a—injecting water into a tray of crescent shaped cavities arranged in a row and at least some of which are divided into two oppositely positioned partial crescent shaped cavities by a paddle shaped rectangularly configured ejector element which is attached at one end thereof to a rotatable shaft to form two rows of half crescent shaped volumes of water together around said ejector elements by a water bridge;

b—freezing said water to form at least some partial shaped crescent shaped ice pieces connected to their oppositely positioned half crescent shaped ice pieces by an ice bridge;

c—heating said rotatable shaft along its entire length to also heat by conduction the ejector elements secured to said rotatable shaft to free the ice pieces frozen to said ejector elements from said ejector elements;

d—rotating said rotatable shaft and thus rotating said attached ejector elements;

e—impeding the rotation of said bridged pairs of half crescent ice pieces to push them away from said rotating shaft and from said warmed ejector elements as said shaft continues to rotate; and f—further impeding the movement of said pairs of ice pieces to cause them to fall away from said ejector elements and into a receiving tray.

5. A method as in claim 4 in which steps "e" and "f" further comprise the steps of:

impeding further rotation of said bridge pairs of half crescent ice pieces by rising slopes of ice piece stripper elements to cause said rotating ejector elements to quickly push said ice pieces upwardly on said rising slopes and away from said heated ejector elements;

pushing said bridged pairs of half crescent shaped ice pieces past the peak of said rising slope of said stripper elements and onto a descending portion of said stripper element which enable the bridged ice pieces to slide over the edge of said tray and into a collection bin.

6. A method as in claim 4 in which step "c" further comprises the steps of:

forming said rotatable shaft to have a bore extending substantially along the entire length thereof;

inserting a heater element along the length of an elongated substantially cylindrical tube dimensioned to fit within the length of the bore of said rotatable shaft;

inserting said cylindrical tube to be non-rotatable with respect to said rotatable shaft; and heating said heater element at predetermined times during an ice piece making cycle to in turn heat the cylindrical tube, the rotatable shaft and ejector elements to free the full crescent shaped ice piece comprising the bridged half crescent ice pieces from said ejector elements.

7. An ice maker comprising a row of crescent shaped cavities positioned side by side:

a rotatable shaft assembly comprising a rotatable shaft having a plurality of ejector elements secured at a first end thereof to said rotatable shaft and having its second end extending into at least some of said crescent shaped cavities to divide said crescent shaped cavities into partial crescent shaped cavities;

first means for injecting water into said cavities;

second means for freezing said water to form partial crescent shaped ice pieces which are frozen to said ejector elements;

third means for rotating said assembly of said rotatable shaft and said ejector elements;

fourth non-rotatable heater means for heating said rotatable shaft along its entire length as said assembly of rotatable shaft and said attached ejector elements rotate to melt the frozen bond between said frozen partial crescent shaped ice pieces and said ejector elements; and fifth means for diverting said ice pieces from said ejector elements and outside said cavities.

8. An ice maker in accordance with claim 7 in which:

said rotatable shaft comprises a bore extending substantially along the entire length thereof and:

in which said fourth non-rotatable heater means comprises a cylindrical tube insertable along the length of said bores in said rotatable shaft and which is non-rotatable;

a heater element insertable within said cylindrical tube; and means for heating said heater element to heat said non-rotatable cylindrical shaft, said rotatable shaft, and said ejector element to release said partial crescent shaped ice pieces from said ejector elements as a unitary full crescent shaped ice piece consisting of two partial crescent shaped ice pieces.

9. A method of cylically making pluralities of half crescent shaped ice pieces in a freezer comprising the steps of:

a—injecting water at the beginning of each ice piece making cycle into the cavities of an elongated tray of arcuate cross sectional configuration and divided into water connected crescent shaped cavities by spaced apart partitions positioned in said tray normal to the elongated axis of said tray;

b—rotatably positioning an assembly comprising a rotatable, cylindrical shaft, with ejector elements secured to the external surface of said shaft and extending radially outward from said shaft, substantially coincident with the axis of said elongated tray of arcuate cross sectional configuration;

c—positioning a non-rotatable heater means within said cylindrical shaft to heat said shaft and said ejector elements during predetermined periods;

d—further positioning said assembly of shaft and ejector elements at the beginning of each half crescent shaped ice piece making cycle to insert one of a plurality of said injector elements into each water filled cavity to partially divide each cavity into two substantially half crescent shaped cavity;

e—freezing said water in said cavities to produce crescent shaped ice pieces which are separated into leading and lagging rows of half crescent shaped ice pieces by said ejector elements;

f—rotating said assembly of shaft and attached ejector elements at least one full rotation of 360° about the radial axis of said shaft;

g—heating said heater means to heat said assembly of shaft and ejector elements as said assembly is rotating to free the full crescent ice pieces from said shaft and said ejector elements; and h—forcing said full crescent ice pieces outwardly away from said rotating shaft and outwardly away from said ejector elements and over the edge of said of said elongated tray to fall into a collection bin where the notched crescent shaped ice pieces will break into two half crescent shaped ice pieces.

10. A method as in claim 9 in which steps "h" further comprises steps of:

impeding further rotation of said bridged pairs of half crescent ice pieces by rising slopes of ice piece stripper elements to cause said rotating ejector elements to quickly push said ice pieces upwardly on said rising slopes and away from said heated ejector elements; and pushing said bridged pairs of half crescent shaped ice pieces past the peak of said rising slope of said stripper elements and onto a descending portion of said stripper element which enable the bridged ice pieces to slide over the edge of said tray and into a collection bin.

11. An ice maker comprising an elongated freezing tray having arcuately shaped cross sectional configuration with equal-spaced separators formed therein each in a plane normal to the axis of the elongated freezing tray and comprising:

a rotatable assembly comprising a hollow, cylindrical shaft rotatably secured at both ends to said tray substantially coincident with the axis of said tray and having generally flat paddle-shaped ejector elements formed thereon which extend outwardly from said rotatable shaft with length slightly less than the radial distance between said axis of said tray and the arcuately shaped bottoms of said tray, and a width slightly less than the distance between adjacent partitions of said tray;

a non-rotatable heating element positioned within said hollow cylindrical shaft and comprising means for supplying power thereto to heat said heating element and by conduction to heat said hollow, cylindrical shaft and said ejector elements to release said full crescent shaped ice pieces from said ejector elements;

means, when energized by said power source, for rotating said rotatable shaft, said ejector elements, and said full crescent ice pieces through 360° from the rest position of said rotatable shaft; and stripper means positioned on both sides of each ejector element and each initially intercepting said rotating full crescent shaped ice pieces and forcing said released full crescent shaped ice pieces stripper elements and away from said ejector elements until said crescent shaped ice pieces are pushed over the edges of said stripper elements, out of the freezer tray, and into the collection bin.

12. In a half crescent shaped ice piece maker having an elongated freezing tray with an arcuately shaped cross-sectional inside surface, with equal-spaced partitions formed within said tray parallel to the axis of said arcuately shaped inner surface of said tray to form full crescent shaped cavities, a power source, and an ice piece ejector assembly comprising:

a first rotatable, hollow cylindrical shaft with a second, non-rotatable hollow cylindrical tube positioned substantially along the length of the first hollow shaft and further with a heating element positioned within the length of said second hollow tube;

means, when powered by said power source, for rotating said first rotatable hollow cylindrical shaft and for energizing said heating element;

a timing means for controlling the time of connection of said power source to said first rotatable hollow cylindrical shaft and to said heating element;

said heating element responsive energization by said power source to heat said first hollow shaft, said second hollow shaft, and said second hollow tube, and said ejector elements to release said notched, full crescent ice pieces from said ejector elements;

stripping elements positioned on each side of each ejector element and having a rising portion and a contiguous descending portion beginning at the peak of said rising portion and positioned with the rising portion being in the path of said rotating notched full crescent shaped ice pieces;

means for filling said full crescent shaped ice pieces with water and then freezing said ice pieces with said ejector elements down into one of said frozen full crescent shaped ice pieces to divide each of such full crescent shaped ice pieces into two half crescent shaped ice pieces; and sensing means responsive to the freezing of said full crescent shaped ice pieces to energize said means to rotate said first rotatable hollow cylindrical shaft under the control of said timing control means and to energize said heating during a time period which will enable the surfaces between said ejector elements and said notched full crescent shaped ice pieces to thaw before said ice pieces impact said stripper elements;

said stripper elements responsive to the impact of full crescent shaped ice pieces to cause said full crescent shaped ice pieces to move up and away from said ejector elements and finally move over the peak of said stripper elements and onto the descending slope of said stripper elements and down into the collection bin.

13. A method of making half crescent shaped ice pieces comprising the steps of:

a—injecting water in the crescent shaped cavities of an elongated arcuately shaped tray having adjacent partitions spaced apart an equal distance and positioned in planes normal to the radial axis of said arcuately shaped tray;

b—positioning a cylindrical rotatable shaft with its axis coincident with the axis of said arcuately shaped tray;

c—initially positioning a plurality of paddle-like elements, aligned in a common plane and secured to said cylindrical rotatable shaft, individually into the center of each of said cavities to divide the crescent shaped volume of water therein into half crescent shaped volumes of water;

d—freezing the water in each of said cavities to produce a notched full crescent shaped ice piece with the notch being formed by the presence of said ejector element therein;

e—heating said cylindrical shaft substantially along its entire length which in turn will heat the ejector elements secured thereto to free the notched, full crescent shaped ice pieces to form said ejector elements;

f—rotating said cylindrical shaft to rotate said ejector elements and said notched, full crescent shaped full ice pieces;

g—impeding the rotating notched, full crescent shaped ice piece by impact with the rising slope of ice piece stripper elements positioned alongside each stripper element; and h—moving the ice pieces up said rising slope and over the peak thereof to a descending slope portion of said stripper elements which is contiguous with the end of the rising slope portion of said stripper elements at which time the notched, full crescent shaped ice pieces will, freed from the ejector elements, will slide down said descending slope and into a collection bin where they will break into two half crescent shaped ice pieces.

14. A method as in claim 13 in which step "e" further comprises the steps of:

forming said rotatable shaft to have a bore extending substantially along the entire length thereof;

inserting a heater element along the length of an elongated substantially cylindrical tube dimensioned to fit within the length of the bore of said rotatable shaft;

inserting said cylindrical heater containing tube within the bore of said rotatable shaft;

securing said cylindrical tube to be non-rotatable with respect to said rotatable shaft; and heating said heater element at predetermined times during an ice piece making cycle to in turn heat the cylindrical tube, the rotatable shaft and ejector elements to free the full crescent shaped ice piece comprising the bridged half crescent ice pieces from said ejector elements.

15. In an assembly comprising an arcuately shaped elongated tray divided into full crescent shaped cavities by a series of spaced apart separators positioned normal to the axis of the said arcuately shaped tray and a hollow rotatable cylindrical shaft rotatably supported at both ends by bearings with the axis of said rotatable shaft and said arcuately shaped tray being coincident, and with said rotatable shaft having a row of ejector elements secured thereto and lying in a common plane and extending outwardly from said rotatable shaft with a length measured from the axis of said shaft being less than radial distance between the axis of said arcuately shaped tray and the arcuate surface of said tray, a method of making half crescent shaped ice pieces comprising the steps of:

a—initiating a cycle of operation with the row of ejector elements extending into the center of said full crescent shaped cavities;

b—injecting water into said cavities;

c—freezing said water to form full crescent shaped ice pieces with the ejector elements partially dividing said full crescent shaped ice pieces into two half crescent shaped ice pieces;

d—rotating said rotatable shaft and thereby rotating said ejector elements and said half crescent shaped ice pieces;

e—heating the entire length of said shaft substantially uniformly as said shaft is rotating to melt the ice bond between the ejector elements and the full crescent shaped ice pieces; and f—impeding the rotation of said full crescent shaped ice pieces by the rising slope of a row of stripper elements to cause said full crescent shaped ice pieces to quickly move outwardly and away from said ejector elements until said ice pieces pass over the peak of said rising slope unto the descending slope of said stripper elements at which time said notched full crescent ice pieces will slide down said descending slope and into a collection bin.

16. A method as in claim 15 in which step "e" further comprises the steps of:

forming said rotatable shaft to have a bore extending substantially along the entire length thereof;

inserting a heater element along the length of an elongated substantially cylindrical tube dimensioned to fit within the length of the bore of said rotatable shaft;

securing said cylindrical tube to be non-rotatable with respect to said rotatable shaft; and heating said heater element at predetermined times during an ice piece making cycle to in turn heat the cylindrical tube, the rotatable shaft and the ejector elements to free the full crescent shaped ice piece comprising the bridged half crescent ice pieces from said ejector elements.

* * * * *